US009481435B1

(12) United States Patent
Jaszewski et al.

(10) Patent No.: US 9,481,435 B1
(45) Date of Patent: Nov. 1, 2016

(54) ASSEMBLIES FOR MOUNTING OUTBOARD MOTORS TO A MARINE VESSEL TRANSOM

(71) Applicant: Brunswick Corporation, Lake Forest, IL (US)

(72) Inventors: Wayne M. Jaszewski, Jackson, WI (US); Randall J. Poirier, Howards Grove, WI (US)

(73) Assignee: Brunswick Corporation, Lake Forest, IL (US)

( * ) Notice: Subject to any disclaimer, the term of this patent is extended or adjusted under 35 U.S.C. 154(b) by 17 days.

(21) Appl. No.: 14/590,377

(22) Filed: Jan. 6, 2015

(51) Int. Cl.

| | |
|---|---|
| ***B63H 20/12*** | (2006.01) |
| ***B63H 20/06*** | (2006.01) |
| *B63H 20/00* | (2006.01) |
| *B63H 20/24* | (2006.01) |

(52) U.S. Cl.
CPC ..... *B63H 20/06* (2013.01); *B63H 20/12* (2013.01); *B63H 20/245* (2013.01); *B63H 2020/003* (2013.01)

(58) Field of Classification Search
CPC B63H 20/06; B63H 20/12; B63H 2020/003; B63H 20/245
USPC ..... 248/639, 640–642; 440/6, 7, 53–60; 114/144 R
See application file for complete search history.

(56) References Cited

U.S. PATENT DOCUMENTS

| | | | | |
|---|---|---|---|---|
| 2,764,119 | A * | 9/1956 | Sigler | B63B 25/08 248/641 |
| 3,202,125 | A * | 8/1965 | Morse | B63H 20/10 440/62 |
| 4,836,811 | A | 6/1989 | Griffiths et al. | |
| 6,146,220 | A | 11/2000 | Alby et al. | |
| 6,183,321 | B1 | 2/2001 | Alby et al. | |
| 6,227,514 | B1 * | 5/2001 | Williams | B63B 17/00 248/640 |
| 6,402,577 | B1 * | 6/2002 | Treinen | B63H 25/30 440/61 C |
| 6,406,340 | B1 | 6/2002 | Fetchko et al. | |
| 6,682,374 | B2 * | 1/2004 | Kokubo | B63H 20/10 440/53 |
| 6,761,599 | B2 * | 7/2004 | Ferguson | B63H 20/12 440/61 R |
| 6,913,497 | B1 | 7/2005 | Ahlswede et al. | |
| 7,527,537 | B2 * | 5/2009 | Mizutani | B63H 20/12 114/144 E |
| 8,905,801 | B1 * | 12/2014 | Craft | F01N 13/004 123/54.2 |
| 9,156,535 | B2 * | 10/2015 | Mizutani | B63H 25/42 |
| 2003/0024456 | A1 * | 2/2003 | Swetish | B63H 20/007 114/144 R |
| 2007/0089660 | A1 * | 4/2007 | Bradley | B63H 25/42 114/144 A |
| 2011/0028057 | A1 * | 2/2011 | Torrangs | B63H 20/12 440/53 |
| 2012/0244761 | A1 * | 9/2012 | Davidson | B63H 20/12 440/61 S |
| 2014/0106631 | A1 * | 4/2014 | Ito | B63H 21/21 440/1 |
| 2014/0106632 | A1 * | 4/2014 | Nakayasu | B63H 21/21 440/1 |
| 2014/0329422 | A1 * | 11/2014 | Ito | B63H 20/12 440/1 |
| 2014/0364019 | A1 * | 12/2014 | Ito | B63H 20/12 440/1 |
| 2015/0072575 | A1 * | 3/2015 | Mizutani | B63H 25/42 440/1 |
| 2015/0127197 | A1 * | 5/2015 | Lindeborg | B63H 25/02 701/21 |
| 2015/0166159 | A1 * | 6/2015 | Inoue | B63H 20/12 440/53 |

* cited by examiner

*Primary Examiner* — Nkeisha Smith
(74) *Attorney, Agent, or Firm* — Andrus Intellectual Property Law, LLP

(57) ABSTRACT

An assembly is provided for mounting an outboard motor to a transom of a marine vessel. A support structure is configured to be coupled to the transom by a plurality of fasteners that extend through the support structure and through a set of holes that have been drilled in the transom. A steering head is coupled to the support structure and configured to support an outboard motor thereupon for rotation about a generally vertical steering axis. The set of holes is divided by a generally vertical fore-aft central plane, and the outboard motor extends along a generally vertical fore-aft central plane. The support structure and the steering head are coupled to one another such that the central plane of the outboard motor is capable of being laterally offset from the central plane of the set of holes. An assembly for mounting two or more outboard motors is also provided.

12 Claims, 9 Drawing Sheets

ASSEMBLIES FOR MOUNTING OUTBOARD MOTORS TO A MARINE VESSEL TRANSOM

FIELD

The present disclosure relates to assemblies for mounting an outboard motor or a plurality of outboard motors to a transom of a marine vessel.

BACKGROUND

U.S. Pat. No. 6,402,577, hereby incorporated herein by reference, discloses a hydraulic steering system in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a moveable second portion of the steering actuator. The moveable second portion of the steering actuator moves linearly within a cylinder cavity formed in a first portion of the steering actuator.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example, the present disclosure includes an assembly for mounting two or more outboard motors to a transom of a marine vessel. The assembly comprises a first support structure that is configured to be coupled to the transom by a first plurality of fasteners that extend through the first support structure and through a first set of holes that have been drilled in the transom. A first steering head is coupled to the first support structure and is configured to support a first outboard motor thereupon for rotation about a first generally vertical steering axis. A second support structure is configured to be coupled to the transom by a second plurality of fasteners that extend through the second support structure and through a second set of holes that have been drilled in the transom. A second steering head is coupled to the second support structure and is configured to support a second outboard motor thereupon for rotation about a second generally vertical steering axis. The first set of holes is divided by a generally vertical fore-aft central plane, and the first outboard motor extends along a generally vertical fore-aft central plane. The first support structure and the first steering head are coupled to one another such that the central plane of the first outboard motor is capable of being laterally offset from the central plane of the first set of holes.

Another example of the present disclosure is of an assembly for mounting an outboard motor to a transom of a marine vessel. The assembly comprises a support structure configured to be coupled to the transom by a plurality of fasteners that extend through the support structure and through a set of holes that have been drilled in the transom. A steering head is coupled to the support structure and configured to support an outboard motor thereupon for rotation about a generally vertical steering axis. The set of holes is divided by a generally vertical fore-aft central plane, and the outboard motor extends along a generally vertical fore-aft central plane. The support structure and the steering head are coupled to one another such that the central plane of the outboard motor is capable of being laterally offset from the central plane of the set of holes.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
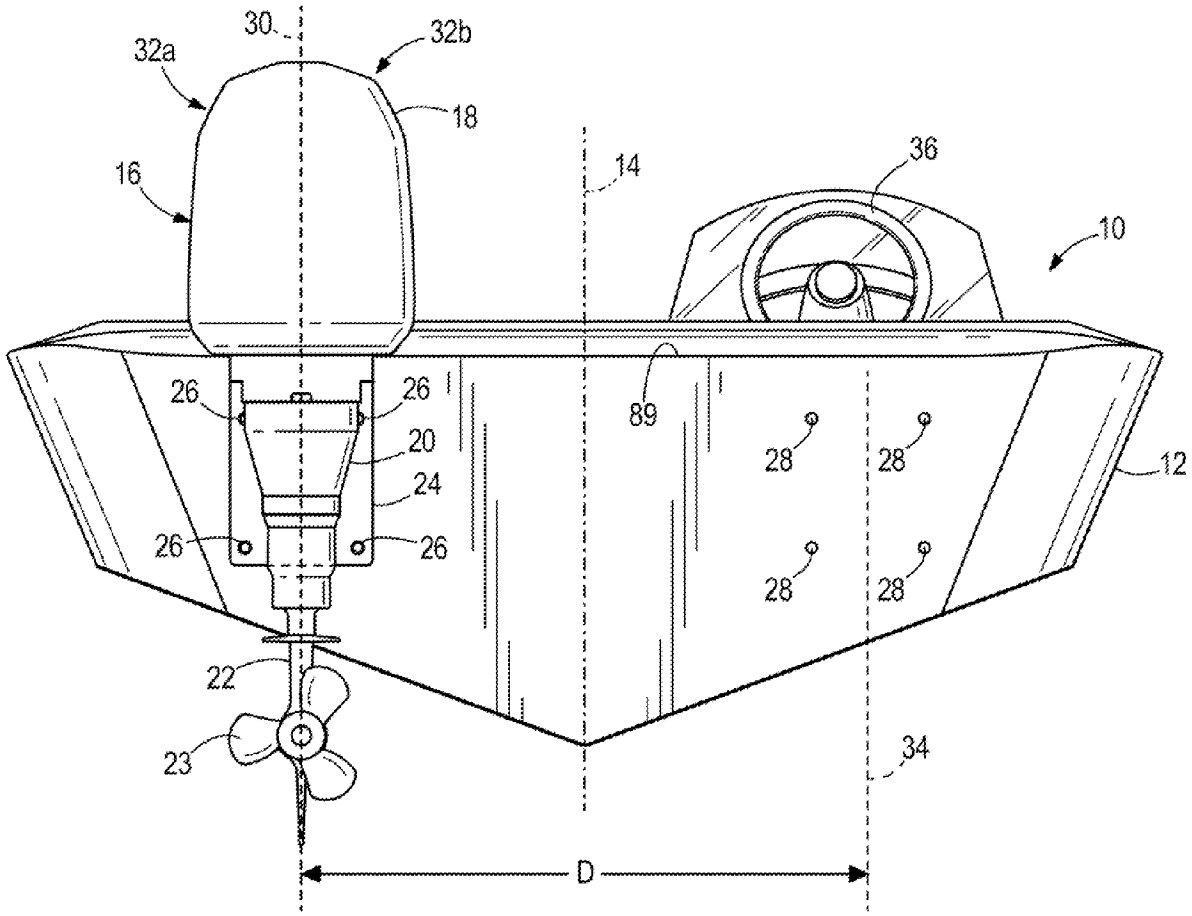
FIG. 1 illustrates a rear view of a marine vessel including an outboard motor.

FIG. 1 illustrates a rear view of a marine vessel 10. More specifically, the transom 12 of the marine vessel 10 is shown. The marine vessel 10 and transom 12 can be divided into two roughly equal halves by an imaginary centerline 14. An outboard motor 16 is shown mounted to the left of the centerline 14 on the transom 12. Although only one outboard motor 16 is shown in the figure, it should be understood that another outboard motor could be mounted on the right side of the centerline 14, thus providing a mirror image on either side of the centerline 14.

The outboard motor 16 includes a powerhead 18 extending generally above a top edge 89 of the transom 12, a midsection housing 20 mounted generally in line with the transom 12, and a lower unit 22 extending mostly below the transom 12. As known, the powerhead 18 includes an engine, an engine control unit, and other related components. The midsection housing 20 includes components such as a driveshaft that extends to the lower unit 22, an exhaust passageway, and/or an oil sump. The lower unit 22 comprises a gear set and a propeller 23 that can be driven by the engine housed in the powerhead 18 via a coupling through the drive shaft. These components are well known in the art, and will not be described further herein.

In the example shown, the midsection housing 20 is mounted to the transom 12 via a support structure 24. Although the support structure 24 is shown as a rectangle herein, it should be understood that the support structure 24 could take many different shapes and might not even be visible from the rear due to the size, shape, and/or location of the midsection housing 20. However, the support structure 24 is shown herein for purposes of defining several different aspects of the marine vessel 10 and mounting assembly shown herein. The support structure 24 is held to the transom 12 of the marine vessel 10 via a plurality of fasteners 26, such as bolts, screws, or the like. Those having ordinary skill in the art will appreciate that many different types of fasteners could be used, and the exact fastener is not limiting on the scope of the present disclosure. Four fasteners 26 are shown as mounting the support structure 24 to the transom 12; however, fewer or more fasteners 26 could be provided, depending on the configuration of the support structure 24.

To the right of the centerline 14, the transom 12 is shown with a set of four holes 28 drilled through it. Generally, these holes 28 can be made by holding a template to the transom 12 and drilling the holes 28 perpendicularly through the transom 12. The support structure 24 can then be brought proximate the transom 12 and fastened thereto by inserting the plurality of fasteners 26 through the set of holes 28. (See FIG. 3 for an example.) It can be seen that the pattern of holes 28 provided in the transom 12 on the right side of the centerline 14 generally matches the pattern of fasteners 26 in the support structure 24 on the left side of the centerline 14. Thus, it is easy to see how a second outboard motor 16 could be attached to the transom 12 over this pre-drilled pattern of holes 28 by insertion of a second plurality of fasteners 26 through a second support structure 24 and into the holes 28. It should be noted that fewer or greater than four holes 28 could be provided, and the configuration of the holes 28 could be different from that shown, depending on the configuration of the support structure 24.

The dashed line indicated at 30 is meant to show a rear view of a generally vertical central plane along which the outboard motor 16 extends, and that defines two lateral halves 32*a*, 32*b* thereof. Although only a line is shown at 30, it should be understood that the central plane extends into the page in a fore-aft direction parallel to the centerline 14 of the marine vessel 10. Meanwhile, dashed line 34 is meant to show a generally vertical fore-aft central plane that divides the set of holes 28. In other words, there is an approximately equal distance from the central plane 34 to a hole 28 located on the left side thereof as there is from the central plane 34 to a mirror-image hole 28 located on the right side thereof. Even if the holes 28 were provided in a different configuration than that shown here, a central plane that divided the holes 28 into mirror images of one another could be defined. It should be understood that a central plane also divides a set of holes (through which fasteners 26 extend) on the left side of the centerline 14 of the marine vessel 10. In the example shown, this central plane would divide the plurality of fasteners 26 in half and would be directly in line with the central plane 30 of the outboard motor 16.

A distance "D" can be defined between the central plane 30 of the outboard motor 16 and the central plane 34 of the set of holes 28. On many standard marine vessels, this distance D is equal to 26 inches. In other words, when two outboard motors 16 are mounted to the marine vessel 10, their central planes 30 are about 26 inches (or less) apart from one another. These lines 30, 34 can also be used to indicate where a vertical steering axis of the outboard motor 16 would be located when viewed from behind the outboard motor 16. In other words, dashed line 30 could also represent a vertical steering axis of an outboard motor on the left hand side of the marine vessel 10, and dashed line 34 could also represent a vertical steering axis of an outboard motor on the right hand side of the marine vessel 10. Typically, the steering axes of two or more outboard motors mounted on a single transom 12 are spaced at the distance D from one another.

The present inventors have realized that as consumers have required more power from their outboard motors, outboard motors have in turn become bigger, especially in the powerhead 18 section, in order to accommodate an engine that is large enough to meet the consumer's power needs. Having a large powerhead 18 increases the cowl size of the outboard motor 16, and especially when the marine vessel 10 is turning, or tiling and turning, the cowls of large outboard motors 16 could contact one another. For example, when an operator of the marine vessel 10 uses a steering wheel 36 to rotate the outboard motors 16 around their vertical steering axes to one side or the other, this could cause the outboard motors 16 to collide with one another. Interference also occurs when the outboard motors 16 are tilted or trimmed about horizontal tilt/trim axes. When two or more outboard motors 16 are both rotated around their vertical steering axes and tilted/trimmed, the interference is magnified. On a brand new marine vessel, this interference can be prevented by drilling holes in the marine vessel transom 12 that are further apart than the standard 26 inches. However, larger outboard motors 16 remain a problem when repowering a used marine vessel 10.

Repowering a marine vessel entails providing new outboard motor(s) on the transom 12 of a used marine vessel 10. Often times, consumers wish to use the same holes that have already been drilled in the transom 12 for the old outboards, rather than to drill new holes in order to provide enough clearance for the new, larger outboard motors. Doing so avoids the need to close up the existing holes with silicone or a waterproof epoxy, which is not aesthetically pleasing. Re-using pre-existing holes also avoids the need to put more holes in an already well-worn transom 12. Additionally, the extra clearance needed between the larger outboard motors may be only a matter of a few inches, and holes that are newly drilled might be so close to the pre-existing holes that the integrity of the transom may be compromised. However, the present inventors have realized that if consumers use the set of pre-existing holes 28 already drilled in the transom 12 to mount new, larger outboards, the outboards will be too close to one another, and will contact one another during turning, tilting, and/or trimming maneuvers. Therefore, the present inventors realized that a mounting assembly was needed that would allow a consumer to re-use pre-existing holes 28 in the transom 12 of the marine vessel 10, but that would also provide increased clearance between the two or more outboard motors 16. Several different assemblies for achieving increased clearance are described herein below.

Additionally, when repowering, some consumers wish to place the maximum number of outboards possible on an existing transom, which number is limited by the width of the transom and the size of the motors. The present inventors have therefore developed several solutions that allow multiple (3, 4, 5+) outboards to be mounted on a transom, with minimal required clearance between them, while still using the previously-drilled holes in the transom. Several examples of how the assemblies of the present disclosure can be used to provide enough room for a greater number of outboards on an existing transom will also be described below.

Figure 2:
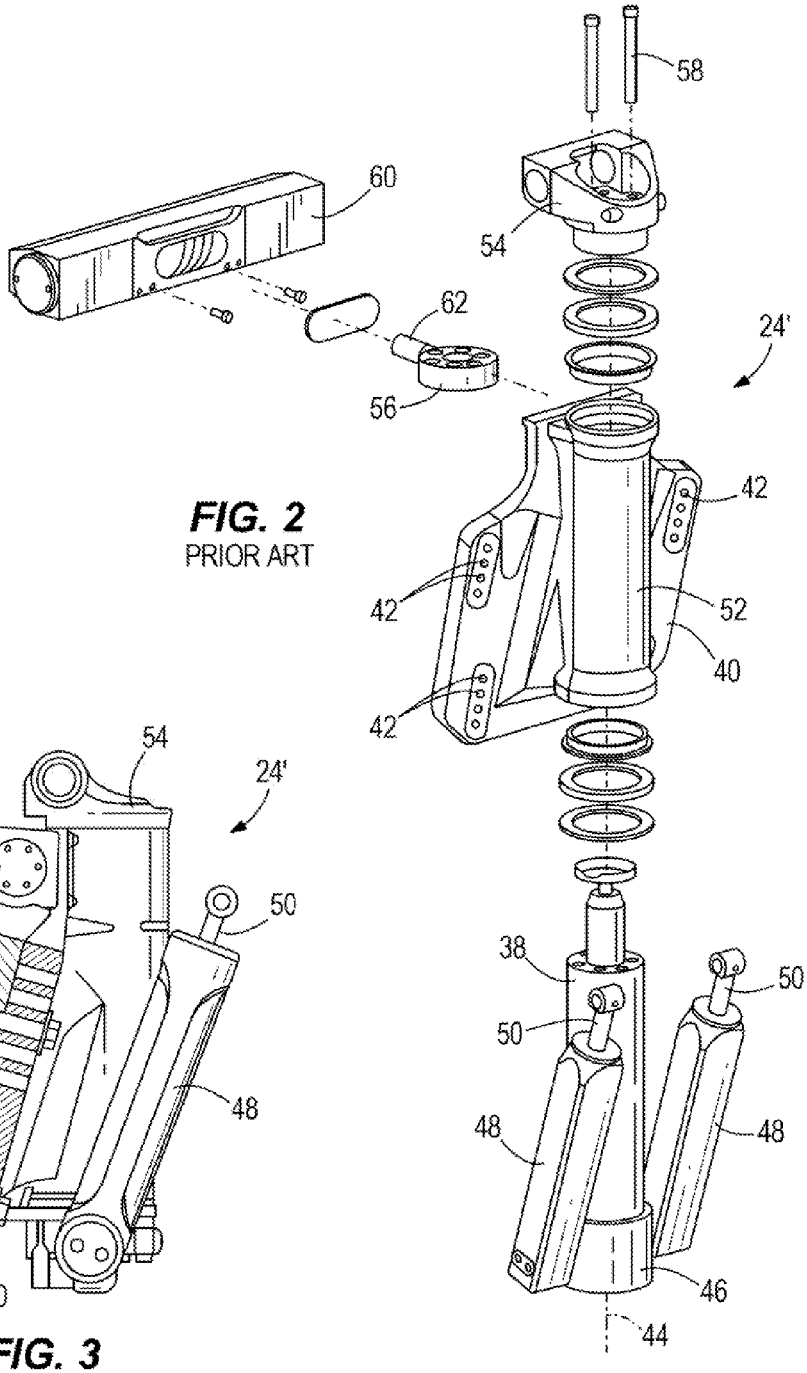
FIG. 2 PRIOR ART
FIG. 2 illustrates an example of a prior art assembly for mounting an outboard motor to a marine vessel.
Figure 3:
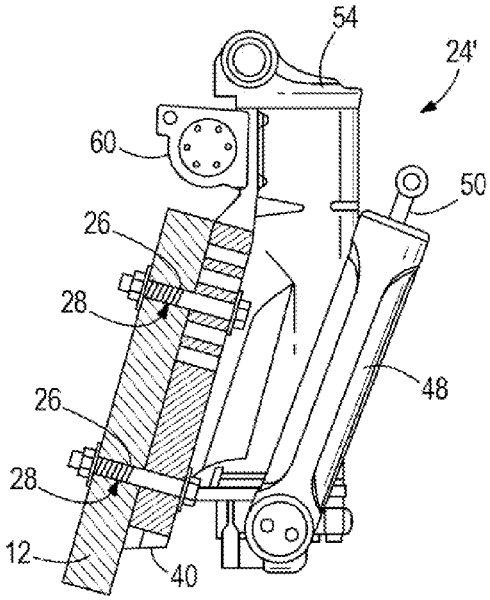
FIG. 3 PRIOR ART
FIG. 3 illustrates a side view of the prior art assembly of FIG. 2.

Before introducing the assemblies of the present disclosure, a prior art support structure 24' will be used to describe various components of a mounting assembly that can be used to hold an outboard motor 16 to a transom 12, as well as to steer, tilt, and trim the outboard motor. FIG. 2 shows a prior art support structure 24' from a rear perspective view, while FIG. 3 shows it from the side. A pedestal 40 is provided for attaching the support structure 24' to the transom 12. The pedestal 40 comprises several areas where fasteners 26 may be inserted through holes 42 extending through the pedestal 40. Numerous holes 42 are provided so that the pedestal 40 can be located at a desired vertical position on the transom 12. A steering tube 38 is provided, which is generally concentric with a steering axis 44 and attached to a base portion 46, to which two hydraulic cylinders 48 having piston rods 50 therein are also attached. Together, the cylinders 48 and rods 50 provide a way by which the outboard motor 16 can be tilted and trimmed about a tilt/trim axis. The steering tube 38 fits within a cylindrical housing 52 attached to or formed as part of the pedestal 40.

A steering head 54 is shaped to be attached to the outboard motor 16 and is rotatable about the steering axis 44. A steering arm 56 is disposed within a cavity on the side of the pedestal 40 that faces the transom 12. The steering arm 56 sticks laterally into the cylindrical housing 52 defined in the pedestal 40. The circular portion of the steering arm 56 is disposed in concentric relation with the steering axis 44. The steering arm 56 is attachable to the steering head 54 by fasteners 58, which also extend into the steering tube 38. Each of these components together are rotatable about the steering axis 44 by way of a steering actuator 60, a portion of which is shown. The steering actuator 60 is attached in force transmitting relationship with the steering arm 56, more specifically by way of an extension 62. More details of the mechanisms that are used to steer the outboard motor 16 around its steering axis 44 are discussed in U.S. Pat. No. 6,402,577, which was incorporated by reference above.

FIG. 3 illustrates how the plurality of fasteners 26 extend through a set of holes 28 in the transom 12 to secure the pedestal 40 thereto.

PRESENT DISCLOSURE

Figure 4:
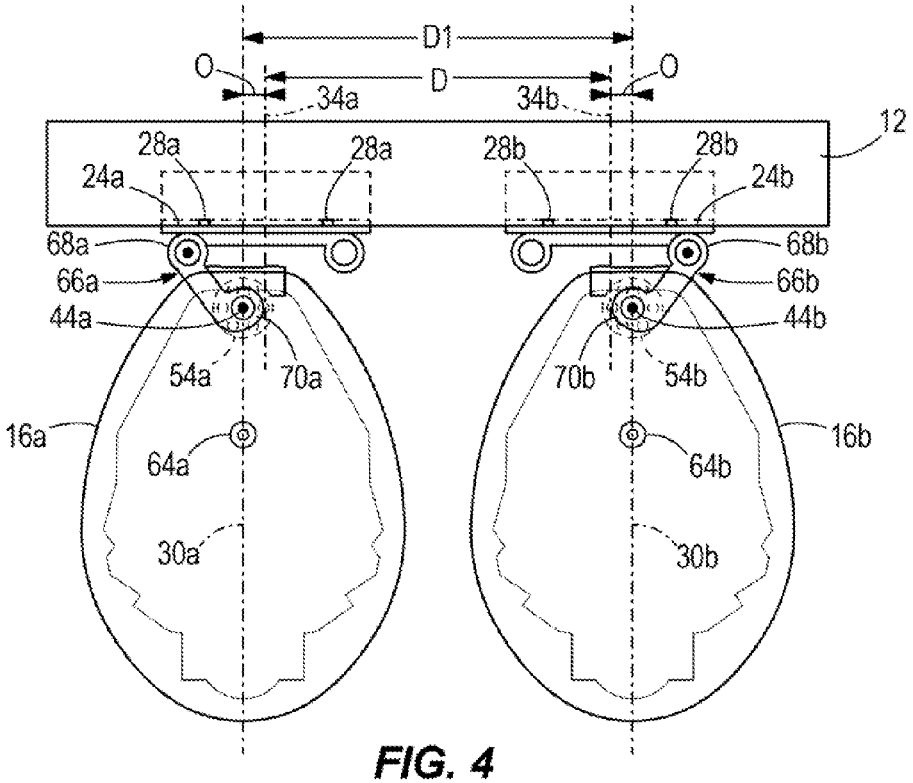
FIG. 4 illustrates a schematic top view of one example of an assembly for mounting outboard motors to a transom of a marine vessel, according to the present disclosure.

Now turning to FIG. 4, it can be seen that the assembly of the present disclosure is for mounting two or more outboard motors 16*a*, 16*b* to a transom 12 of a marine vessel 10. The assembly comprises a first support structure 24*a* configured to be coupled to the transom 12 by first plurality of fasteners 26 (see FIG. 1) that extend through the first support structure 24*a* and through a first set of holes 28*a* that have been drilled in the transom 12. A first steering head 54*a* is coupled to the first support structure 24*a* and is configured to support a first outboard motor 16*a* thereupon for rotation about a first generally vertical steering axis 44*a*. A second support structure 24*b* is configured to be coupled to the transom 12 by a second plurality of fasteners 26 that extend through the second support structure 24*b* and through a second set of holes 28*b* that have been drilled in the transom 12 (see FIG. 1). A second steering head 54*b* is coupled to the second support structure 24*b* and configured to support a second outboard motor 16*b* thereupon for rotation about a second generally vertical steering axis 44*b*. The fasteners 26 are not shown in FIG. 4 for purposes of clarity, but it should be understood that they extend through the holes 28 on either side of the central planes 34*a*, 34*b* that are shown.

As described with respect to FIG. 1, the first set of holes 28*a* is divided by a generally vertical fore-aft central plane 34*a*. Similarly, the second set of holes 28*b* is divided by a generally vertical fore-aft central plane 34*b*. The holes 28 will not be shown in FIGS. 5-14 for clarity, but it should be understood that they exist on either side of the central planes 34*a*, 34*b* that are shown. The first outboard motor 16*a* extends along a generally vertical fore-aft central plane 30*a*. Similarly, the second outboard motor 16*b* extends along a generally vertical fore-aft central plane 30*b*. (Because FIG. 4 shows the assembly from the top, the top view of the vertical planes 30*a*, 30*b*, 34*a*, 34*b* is shown.) According to the present disclosure, the first support structure 24*a* and the first steering head 54*a* are coupled to one another such that the central plane 30*a* of the first outboard motor 16*a* is capable of being laterally offset from the central plane 34*a* of the first set of holes. Similarly, the second support structure 24*b* and the second steering head 54*b* are coupled to one another such that the central plane 30*b* of the second outboard motor 16*b* is capable of being laterally offset from the central plane 34*b* of the second set of holes. It should be understood that although the steering heads 54*a*, 54*b* are in reality not visible due to the powerheads 18 of the outboard motors being situated above them, the steering heads 54*a*, 54*b* are shown in FIG. 4 for purposes of indicating their location. Additionally, FIG. 4 illustrates how first and second drive shafts 64*a*, 64*b* of each outboard motor 16*a*, 16*b*, respectively, are also located along the central plane 30*a*, 30*b* of each outboard motor.

The lateral offset of the central planes 30*a*, 30*b* of the outboard motors 16*a*, 16*b* from the central planes 34*a*, 34*b* of the first and second sets of holes is illustrated by comparing the distance D, separating the two central planes 34*a*, 34*b* of the two sets of holes 28*a*, 28*b*, with a distance D1, separating the central planes 30*a*, 30*b* of the two outboard motors 16*a*, 16*b*. In the example shown, D1 is greater than D, and this therefore provides more clearance between the outboard motors 16*a*, 16*b*. The lateral offset is defined by the dimension O in the figures.

Figure 5:
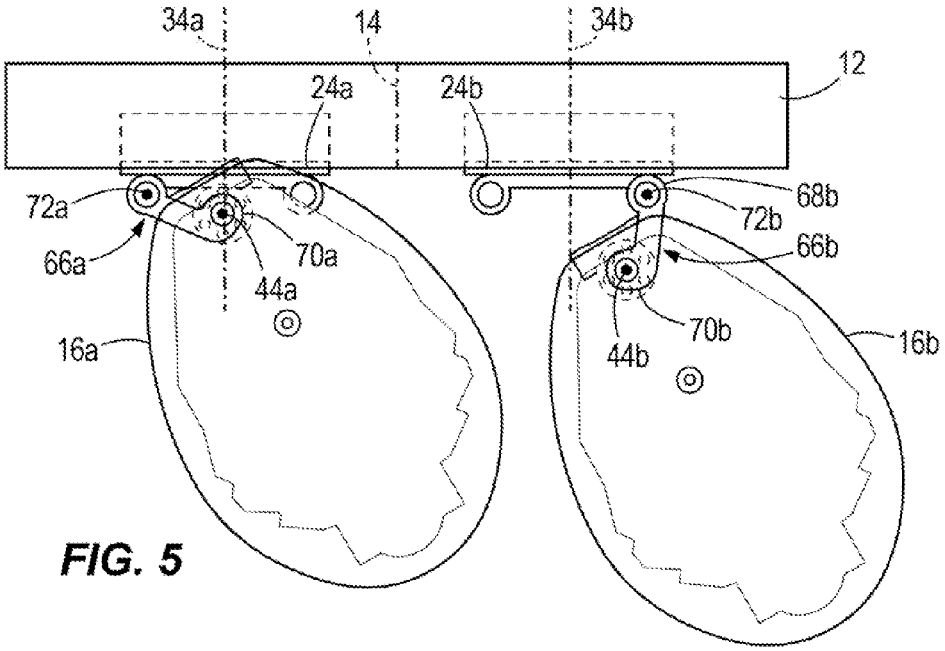
FIG. 5 illustrates the assembly of FIG. 4, with the outboard motors in an alternate position.

More specifically, in the examples of FIGS. 4 and 5, the mounting assembly comprises a bracket 66*a* having a first end 68*a* coupled to the first support structure 24*a*. A second, opposite end 70*a* of the bracket 66*a* supports the first steering head 54*a* thereupon. The bracket 66*a* is shown in the figures for purposes of illustrating its shape and how it is coupled to the first steering head 54*a*. However, it should be understood that the bracket 66*a* would actually not be visible at its second end 70*a* due to the location of the powerhead. For example, the second end 70*a* of the bracket 66*a* may be coupled around the steering axis 44*a* of the outboard motor 16*a* at or just below the steering head 54*a*. In the example shown, the first end 68*a* of the bracket 66*a* is coupled to a lateral side area of the first support structure 24*a*. In this example, the first end 68*a* of the bracket 66*a* is coupled to the first support structure 24*a* on the port side of the first support structure 24*a*.

A similar bracket 66*b* can be provided to support the second outboard motor 16*b*. The first end 68*b* of the bracket 66*b* is coupled to a lateral side area of the second support structure 24*b* on its starboard side. The second end 70*b* of the bracket 66*b* may be coupled around the steering axis 44*b* of the outboard motor 16*b* at or just below the steering head 54*b*.

Thus, although the support structures 24*a*, 24*b* (which can be simple plate-like structures) can be installed using the pre-existing holes 28*a*, 28*b* in the transom, provision of the brackets 66*a*, 66*b* attached to the support structures 24*a*, 24*b* generates greater clearance between the outboard motors 16*a*, 16*b*. It can be seen that providing the lateral offset O locates the central planes 30*a*, 30*b* of the outboard motors 16*a*, 16*b* further apart than they would otherwise be were they to be installed using the prior art bracket shown in FIGS. 2 and 3 and the pre-existing holes having central planes 34*a*, 34*b* separated by the distance D. As shown in FIG. 5, the brackets 66*a*, 66*b* also provide an advantage in that as the marine vessel operator steers the outboard motors 16*a*, 16*b* via the steering wheel 36, actuators (not shown) can move the brackets 66*a*, 66*b* around pivot points 72*a*, 72*b*, where the brackets 66*a*, 66*b* attach to the support structures 24*a*, 24*b*. For example, when the operator of the marine vessel commands the marine vessel 10 to turn in a starboard direction, steering actuators will actuate the outboard motors 16*a*, 16*b* in a counterclockwise direction around their steering axes 44*a*, 44*b*. Due to provision of the bracket 66*b*, the starboard outboard motor 16*b* can also be rotated around the pivot point 72*b*, for example such that the second end 70*b* of the bracket 66*b* rotates around the first end 68*b* of the bracket 66*b* in a counterclockwise direction as well. The port outboard motor 16*a* therefore is provided with more room to undertake its own turning maneuver. Additionally, the bracket 66*a* on the port outboard motor 16*a* may also be rotated in a counterclockwise direction around the pivot point 72*a*, as shown.

Now turning to FIG. 6, another example in which the mounting assembly includes a bracket 74*a* having a first end 76*a* coupled to the first support structure 24*a* and a second, opposite end 78*a* supporting the first steering head 54*a* thereupon will be described. In the example shown in FIG. 6, the support structures 24*a*, 24*b* can be very similar to that shown in FIGS. 2 and 3, and can be attached to the transom 12 via holes 28 provided with central planes 34*a*, 34*b* at the distance D from one another. However, a bracket 74*a* is situated at the top of the cylindrical housing 52 of the structure shown in FIG. 2, rather than the steering head 54*a* being situated thereupon. The steering head 54*a* instead is attached at the second end 78*a* of the bracket 74*a*. In this example, the first end 76*a* of the bracket 74*a* is coupled to a center area of the support structure 24*a*, e.g. at cylindrical housing 52. The first end 76*a* is rotatable about a vertical axis 80*a*, and the steering head 54*a* is rotatable about the steering axis 44*a*. This rotation can be accomplished by coupling the first end 76*a* of the bracket 74*a* to an actuator (similar to actuator 60 shown in FIG. 2) via an arm 75*a*. A separate actuator can be provided for rotating the outboard motor 16*a* about the steering axis 44*a*, or the steering head 54*a* can be geared to a gear situated atop the bracket 74*a* and can rotate automatically in response to rotation of the bracket 74*a* about axis 80*a*.

Figure 6:
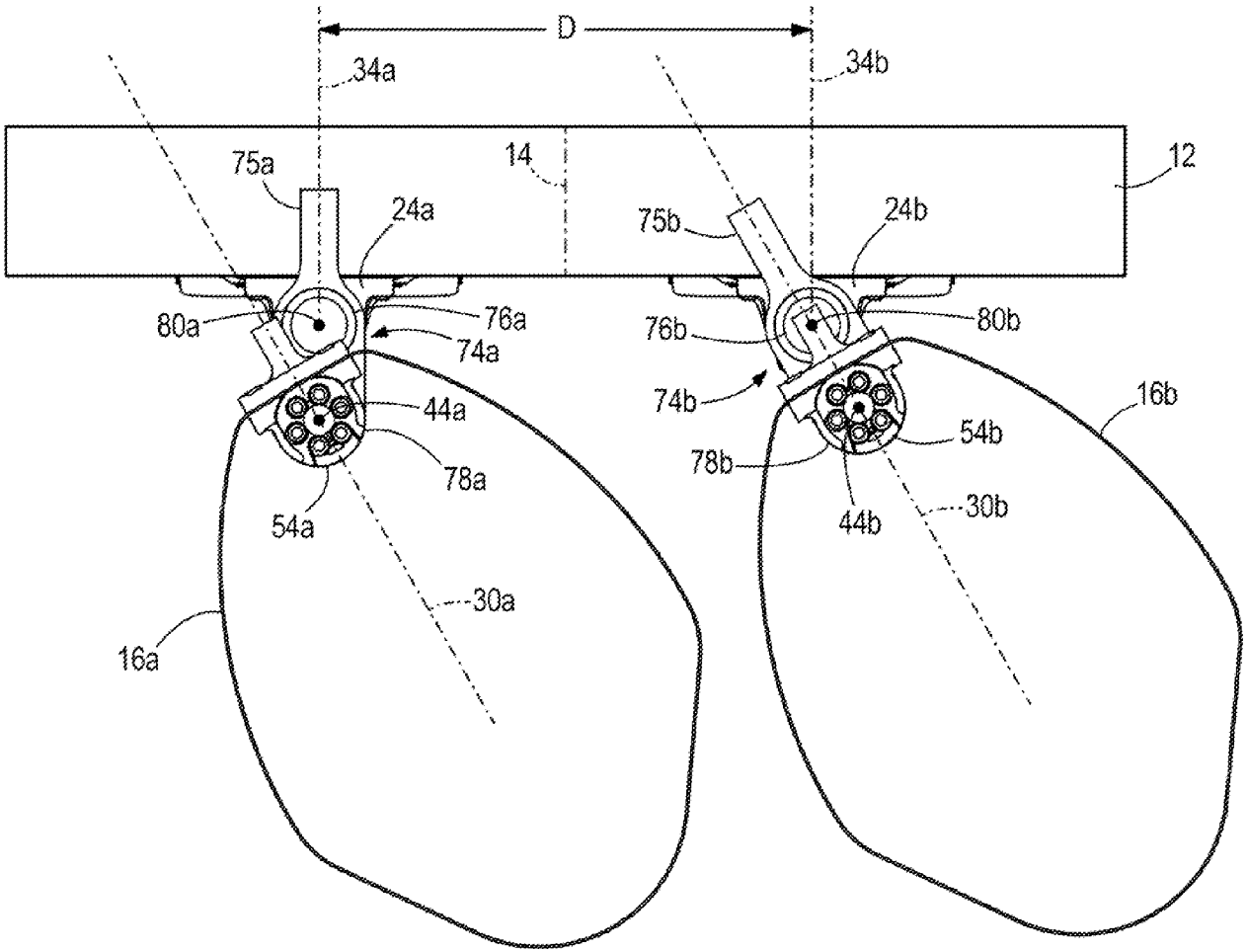
FIG. 6 illustrates another example of an assembly for mounting outboard motors to a transom of a marine vessel, according to the present disclosure.

For purposes of illustration, it should be understood that if the bracket 74*b* on the starboard outboard motor 16*b* were rotated in the orientation shown in FIG. 6, but the outboard motor 16*b* were steered such that its central plane 30*b* extended in a fore-aft direction (i.e. to a steering angle of zero degrees), the central plane 30*b* of the outboard motor 16*b* would be offset from the central plane 34*b* of the holes in the transom 12 via which the support structure 24*b* is attached to the transom 12.

Figure 7:
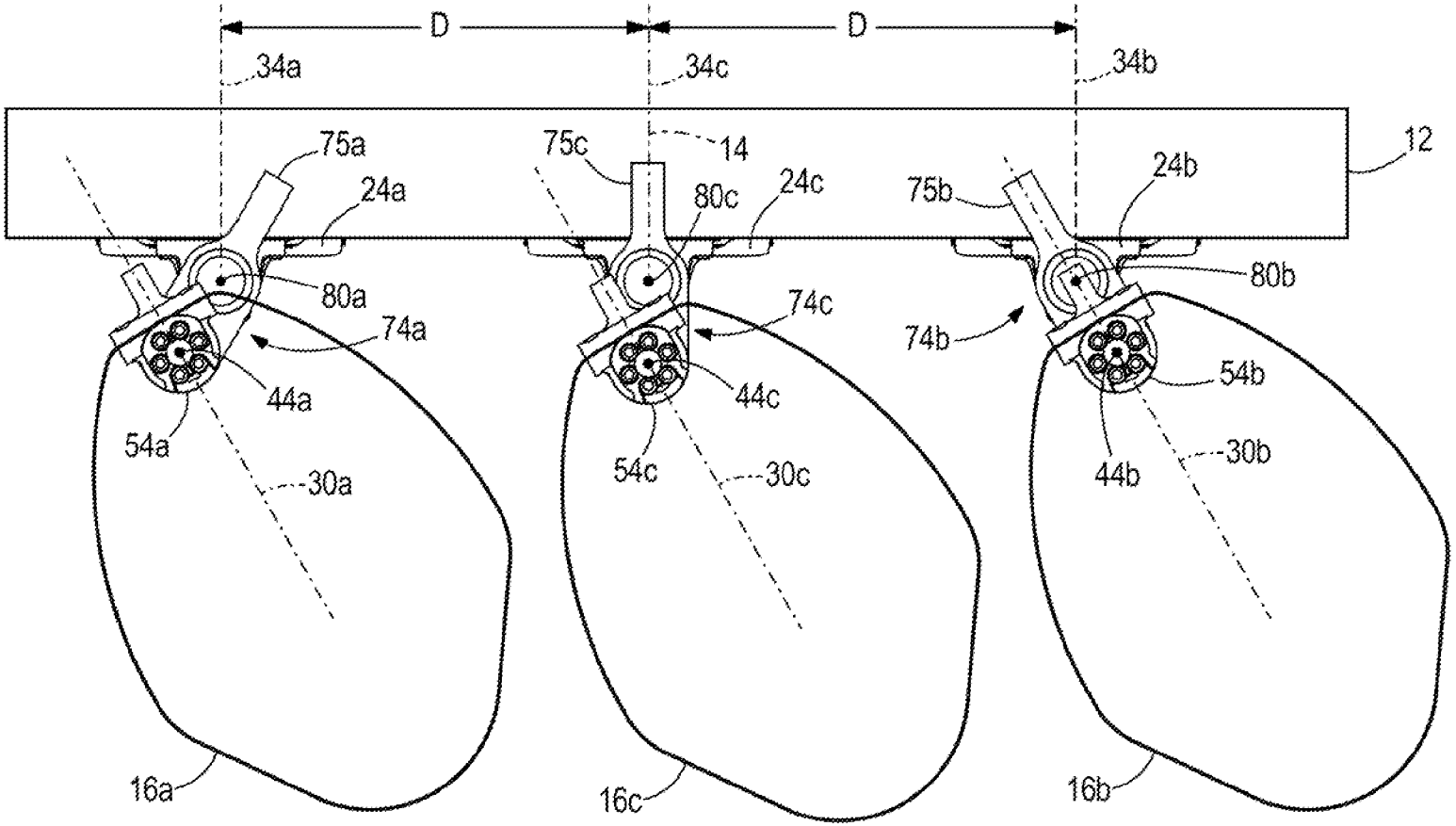
FIG. 7 illustrates the assembly of FIG. 6, wherein three outboard motors are mounted to the transom.

FIG. 7 shows a situation in which three outboard motors 16*a*-16*c* are mounted to the transom using the assembly of FIG. 6. FIG. 7 is used to illustrate how the support structures 24*a*, 24*b*, 24*c* can be used to prevent the outboard motors 16*a*, 16*b*, 16*c* from contacting one another despite their size. Each of the outboard motors 16*a*-16*c* can be rotated around both the axes 80*a*-80*c* of the brackets 74*a*-74*c*, as well around as their individual steering axes 44*a*-44*c*. Although each of the axes 80*a*-80*c* may be provided at the distance D away from one another, the central planes 30*a*-30*c* of the outboard motors are able to be offset from the central planes 34*a*-34*c* of the sets of holes that are used to mount the support structures 24*a*-24*c* to the transom 12. The steering heads 54*a*-54*c* are also able to be offset from the central planes 34*a*-34*c* in response to the brackets 74*a*-74*c* pivoting about the axes 80*a*-80*c*.

Figure 8:
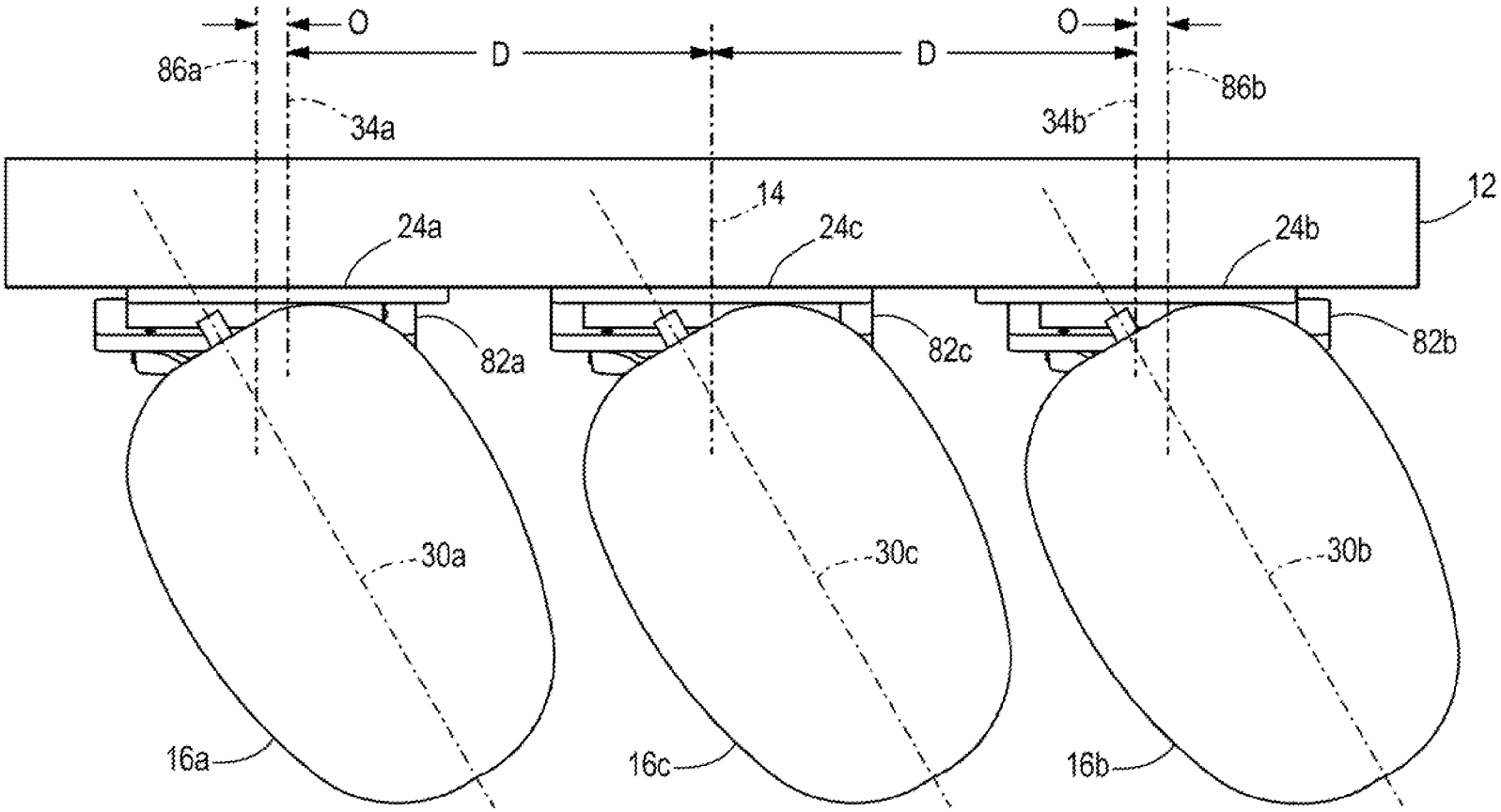
FIG. 8 illustrates yet another example of an assembly for mounting outboard motors to a transom of a marine vessel.
Figure 10:
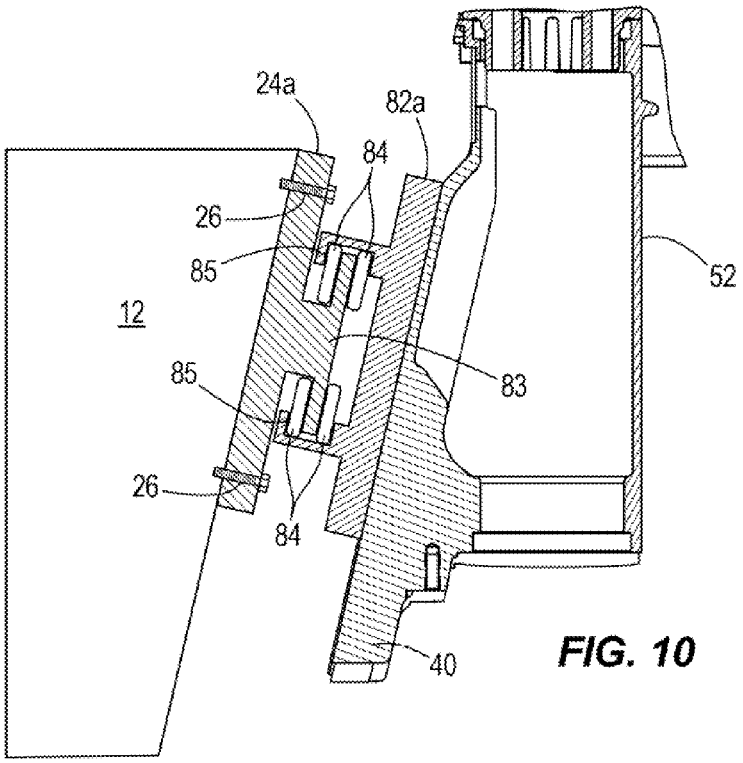
FIG. 10 illustrates a side view of a portion of the assembly of FIGS. 8 and 9.

Turning now to FIG. 8, an example in which the mounting assembly includes a bracket 82*a* that is coupled to and laterally slidable with respect to the support structure 24*a* will be described. A side view of the bracket 82*a* is shown in FIG. 10. It can be seen that the bracket 82*a* can slide along the support structure 24*a*, which is connected to the transom 12, by way of several bearings, rollers, wheels, or the like, as noted at 84. The structure therefore comprises two different parts: the support structure 24*a*, which is attached to the transom 12 and has a supporting rail 83, and the bracket 82*a*, which slides laterally along the supporting rail 83 of the support structure 24*a* via mounting flanges 85. The bracket 82*a* is in turn connected to a pedestal, for example the pedestal 40 shown in FIGS. 2 and 3, which supports the outboard motor thereon. In effect, the structure shown in FIG. 10 acts somewhat as a jack plate, only the movement of the pedestal 40 is in a lateral direction, rather than vertically as with a jack plate.

Returning to FIG. 8, it can be seen that lateral sliding of the brackets 82*a*, 82*b* relative to the support structures 24*a*, 24*b* can offset the centers of the brackets 82*a*, 82*b* from the centers of the support structures 24*a*, 24*b*. If the support structures 24*a*-24*c* are coupled to the typical set of holes 28 in the transom via a plurality of fasteners 26 (see FIG. 1) then the center of a support structure 24*a*-24*c* will be located at the distance D away from that of a neighboring support structure 24*a*-24*c*, yet the centers of the brackets 82*a*-82*c* can be offset further than the distance D from one another. For example, it should be understood that if the starboard outboard motor 16*b* and port outboard motor 16*a* were steered to a zero degree steering angle, such that their central planes 30*b*, 30*a* were oriented in a fore-aft direction as shown by the lines 86*a*, 86*b*, their central planes 30*b*, 30*a* would be offset from the central planes 34*a*, 34*b* of the plurality of holes 28. This is denoted by the offset dimension labeled O in FIG. 8. The steering heads of the outboard motors 16*a*, 16*b* are also offset from the central planes 34*a*, 34*b* by the distance O, no matter what the steering angle is.

Figure 9:
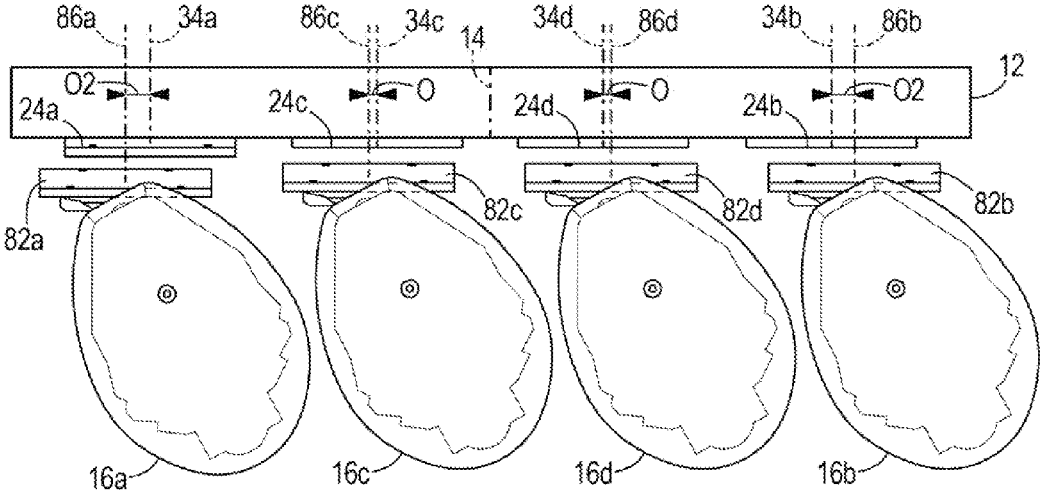
FIG. 9 illustrates the assembly of FIG. 8, wherein four outboard motors are mounted to the marine vessel transom.

FIG. 9 illustrates how the same concept can be used with four outboard motors, so as to provide room for each of them despite their size. The inner port motor 16*c* and inner starboard motor 16*d* are both offset by a distance O from the central planes 34*c*, 34*d* of the sets of holes in the transom 12. The port outboard motor 16*a* and starboard outboard motor 16*b* may be offset by an even greater distance, denoted O2, as shown in the figures. This provides enough room for the inner port and inner starboard motors 16*c*, 16*d* to fit between the outer port and outer starboard motors 16*a*, 16*b*. It should be noted that were the outboard motors 16*a*-16*d* to be steered to zero degree steering angles, their central planes would extend in the fore-aft direction along the lines 86*a*-86*d* as noted.

Figure 11:
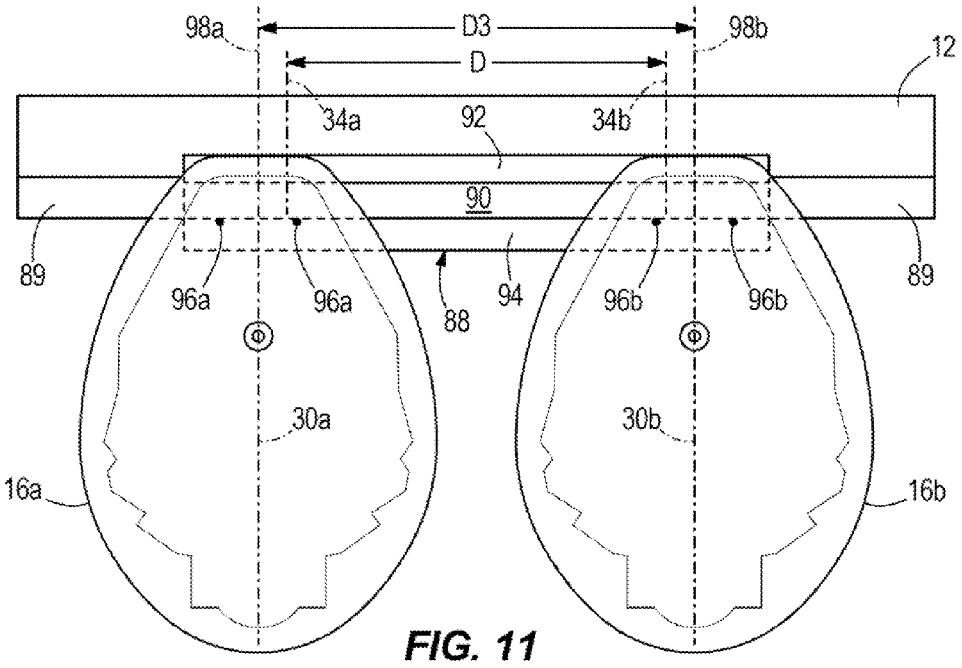
FIG. 11 illustrates another example of an assembly for mounting outboard motors to a transom of a marine vessel.

Now turning to FIG. 11, an example in which the first support structure 24*a* is integral with the second support structure 24*b* will be described. The support structure shown herein is labeled as 88 and in effect comprises a molded piece that extends over a top edge 89 (see FIG. 1) of the transom 12. A top portion 90 of the support structure 88 fits over the top edge 89 of the transom 12, while an attached downwardly extending piece 92 fits on the inside face of the transom 12, and a downwardly extending piece 94 fits on the outer face of the transom 12. Either or both of the parts 92, 94 are bolted to the transom 12 by way of fasteners extending through the pre-existing holes 28 therein. The supplemental supporting structure 88 need not comprise each of the parts 90, 92, 94, but could comprise merely the part 94, which has been bolted into the pre-existing sets of holes 28, or could comprise just the parts 90 and 94.

The support structure 88 therefore effectively creates a new transom, into which new holes can be drilled for insertion of fasteners so as to mount a larger outboard motor thereto. The support structure 88 comprises first and second supplemental sets of holes 96*a*, 96*b*, which are shown schematically, even though it should be understood they would not be able to be seen from the top view due to the powerheads of the outboard motors 16*a*, 16*b*. The first and second supplemental sets of holes 96*a*, 96*b* are provided for attachment of first and second brackets thereto, such as the pedestal 40 shown in the FIG. 2, by way a plurality of supplemental fasteners. The first and second supplemental sets of holes 96*a*, 96*b* in the integral support structure 88 are laterally offset from the first and second sets of holes 28 that have been drilled in the transom 12. This is shown by a comparison of the central planes of the first and second sets of holes, labeled 34*a*, 34*b*, with the lines 98*a*, 98*b*, indicating the central planes of the first and second supplemental sets of holes 96*a*, 96*b*. In other words, the distance D separating the original first and second sets of holes is less than the distance D3 separating the central planes 98*a*, 98*b* of the first and second supplemental sets of holes 96*a*, 96*b*.

Figure 12:
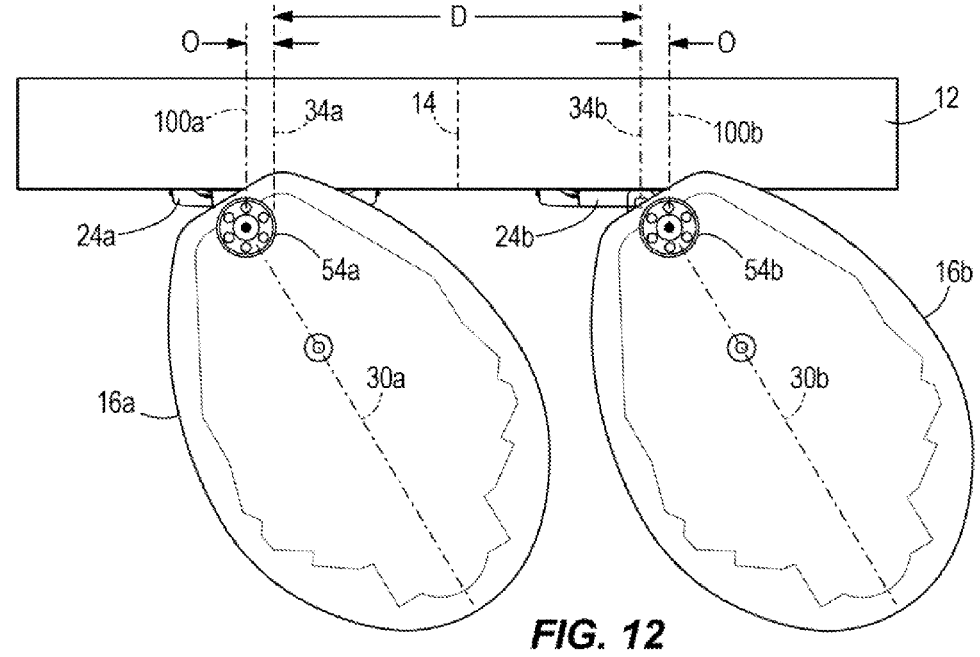
FIG. 12 illustrates another example of an assembly for mounting outboard motors to a transom of a marine vessel.

Turning to FIG. 12, an example in which the steering heads 54*a*, 54*b* are shifted outwardly of the centerline 14 of the marine vessel 10 will be described. In this example, the support structures 24*a*, 24*b* are connected to the transom 12 via the pre-existing holes drilled therein. However, the first steering head 54*a* is coupled to the first support structure 24*a* at a location that is laterally offset from the central plane 34*a* of the first set of holes, and away from the second outboard motor 16. In other words, the first steering head 54*a* is located on a port side of the first support structure 24*a*. Referring to the pedestal 40 of FIG. 2, one example of how this can be accomplished is by moving the cylindrical housing 52 in a lateral direction to a port side of the pedestal 40. The steering head 54, coupled atop the cylindrical housing 52, would therefore shift along with the cylindrical housing 52. Returning to FIG. 12, the second steering head 54*b* is coupled to the second support structure 24*b* at a location that is laterally offset from the central plane 34*b* of the second set of holes, and away from the first outboard motor 16*a*. This means that the steering head 54*b* is coupled to the support structure 24*b* on its starboard side. It should be understood that when the outboard motors 16*a*, 16*b* are at zero degree steering angles, their central planes 30*a*, 30*b* would be offset by the dimension O from the central planes 34*a*, 34*b* of the sets of holes in the transom 12. (See lines 100*a*, 100*b*, denoting where the central planes 30*a*, 30*b* of the outboard motors 16*a*, 16*b* would be at zero degree steering angles.) Offsetting each of the steering heads 54*a*, 54*b* away from one another and away from the centerline 14 of the marine vessel 10 provides more clearance between the outboard motors 16*a*, 16*b*.

Figure 13:
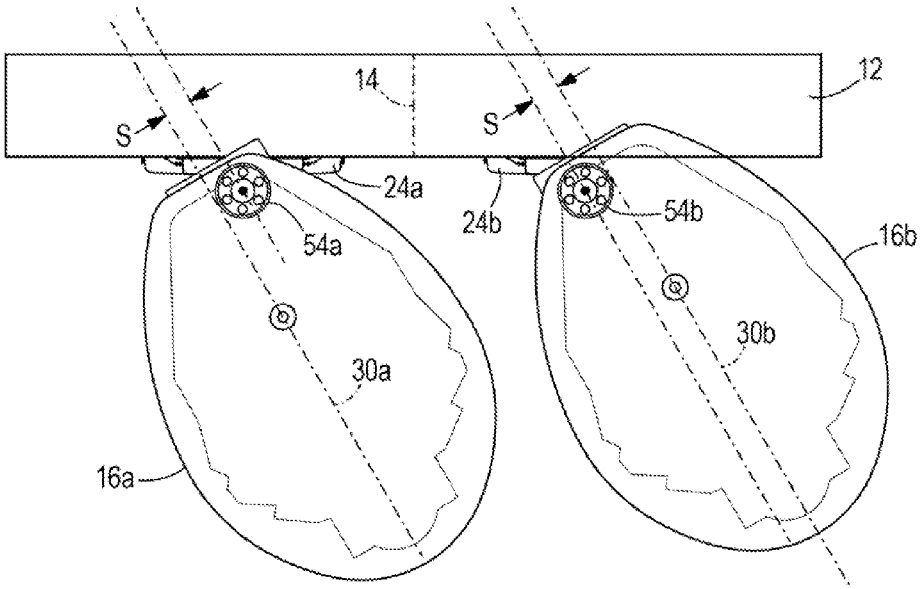
FIG. 13 illustrates another example of an assembly for mounting outboard motors to a transom of a marine vessel.

Turning to FIG. 13, an example in which the steering heads 54*a*, 54*b* are coupled to the outboard motors 16*a*, 16*b* at locations that are laterally offset from the central planes 30*a*, 30*b* of the outboard motors 16*a*, 16*b* will be described. FIG. 13 shows how the first steering head 54*a* is coupled to the first outboard motor 16*a* at a location that is laterally offset from the central plane 30*a* of the first outboard motor 16*a*. This offset is toward the second outboard motor 16*b*, i.e. the steering head 54*a* is moved toward a starboard side of the port outboard motor 16*a* and toward the centerline 14. The second steering head 54*b* is coupled to the second outboard motor 16*b* at a location that is laterally offset from the central plane 30*b* of the second outboard motor 16*b*, and toward the first outboard motor 16*a*. In other words, the steering head 54*b* is located on a port side of the starboard outboard motor 16*b*. This example could utilize the same pedestal 40 as shown in FIG. 2, with the cylindrical housing 52 in its same position as shown therein. However, the location of the connection of the steering heads 54*a*, 54*b* to the outboard motors 16*a*, 16*b* would be shifted. By shifting the steering heads 54*a*, 54*b* of the outboard motors 16*a*, 16*b* in toward one another, more clearance is provided, as a bulk of the outboard motors now lies outwardly of the steering heads. This shift is shown by the dimension S in the figures. It should be understood that were the outboard motors to be in a straight ahead configuration, with a steering angle of zero degrees, this shift denoted by S would cause central planes 30*a*, 30*b* to be offset from the central planes 34*a*, 34*b* of the plurality of holes 28 through which fasteners 26 extend to hold the standard pedestal 40 to the transom 12.

Figure 14:
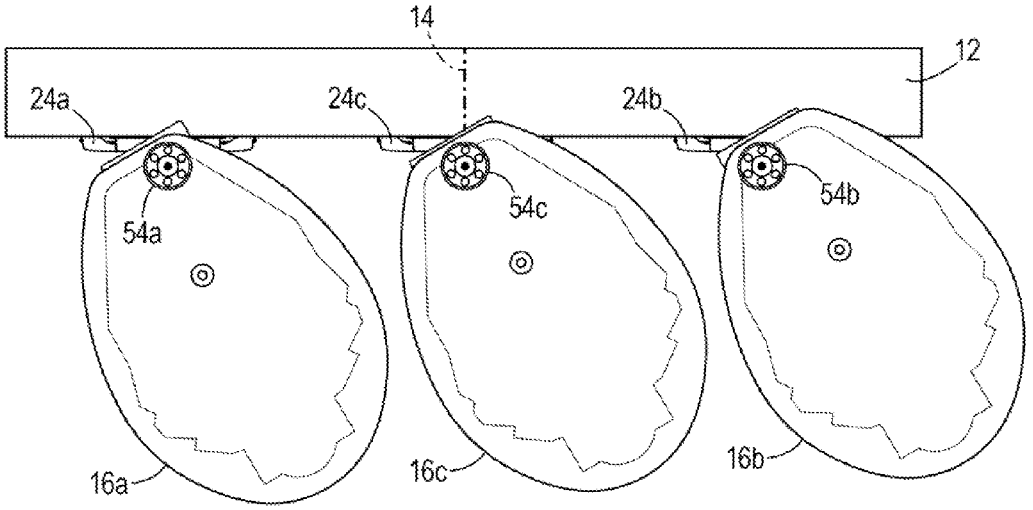
FIG. 14 illustrates the assembly of FIG. 13, wherein three outboard motors are mounted to the marine vessel transom.

FIG. 14 is used to illustrate how when three outboard motors 16*a*, 16*b*, 16*c* are provided, the center outboard motor 16*c* has its steering head situated in the center of the fore part of the outboard motor 16*c*. In other words, the center outboard motor 16*c* is a standard outboard motor mounted on a prior art pedestal 40 as shown in FIG. 2. Meanwhile, the port and starboard outboard motors 16*a*, 16*b* have their steering heads 54*a*, 54*b* laterally shifted so as to provide room for the outboard motor 16*c* between the two.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other assemblies. It is to be expected that various equivalents, alternatives and modifications are possible within the scope of the appended claims.

What is claimed is:

1. An assembly for mounting two or more outboard motors to a transom of a marine vessel, the assembly comprising:

a first support structure configured to be coupled to the transom by a first plurality of fasteners that extend through the first support structure and through a first set of holes that have been drilled in the transom;

a first steering head coupled to the first support structure and configured to support a first outboard motor thereupon for rotation about a first generally vertical steering axis;

a second support structure configured to be coupled to the transom by a second plurality of fasteners that extend through the second support structure and through a second set of holes that have been drilled in the transom; and a second steering head coupled to the second support structure and configured to support a second outboard motor thereupon for rotation about a second generally vertical steering axis;

wherein the first set of holes is divided by a generally vertical fore-aft central plane;

wherein the first outboard motor extends along a generally vertical fore-aft central plane; and wherein the first support structure and the first steering head are coupled to one another such that the central plane of the first outboard motor is capable of being laterally offset from the central plane of the first set of holes.

2. The assembly of claim 1, wherein:

the second set of holes is divided by a generally vertical fore-aft central plane;

the second outboard motor extends along a generally vertical fore-aft central plane; and the second support structure and the second steering head are coupled to one another such that the central plane of the second outboard motor is capable of being laterally offset from the central plane of the second set of holes.

3. The assembly of claim 2, wherein a lateral distance between the central plane of the second set of holes and the central plane of the first set of holes is approximately 26 inches.

4. The assembly of claim 3, further comprising a bracket having a first end coupled to the first support structure, and a second, opposite end supporting the first steering head thereupon.

5. The assembly of claim 4, wherein the first end of the bracket is coupled to a center area of the first support structure.

6. The assembly of claim 4, wherein the first end of the bracket is coupled to a lateral side area of the first support structure.

7. The assembly of claim 2, wherein the first steering head is coupled to the first outboard motor at a location that is laterally offset from the central plane of the first outboard motor, toward the second outboard motor.

8. The assembly of claim 7, wherein the second steering head is coupled to the second outboard motor at a location that is laterally offset from the central plane of the second outboard motor, toward the first outboard motor.

9. The assembly of claim 2, wherein the first steering head is coupled to the first support structure at a location that is laterally offset from the central plane of the first set of holes, away from the second outboard motor.

10. The assembly of claim 9, wherein the second steering head is coupled to the second support structure at a location that is laterally offset from the central plane of the second set of holes, away from the first outboard motor.

11. The assembly of claim 1, further comprising a bracket that is coupled to and laterally slideable with respect to the first support structure, wherein the first steering head is supported by the bracket.

12. The assembly of claim 1, wherein the first support structure is integral with the second support structure, and comprises first and second supplemental sets of holes for attachment of first and second brackets thereto by way of a plurality of supplemental fasteners, and wherein the first and second supplemental sets of holes in the integral support structure are laterally offset from the first and second sets of holes that have been drilled in the transom.

* * * * *